US010442663B2

(12) United States Patent
Okabe et al.

(10) Patent No.: US 10,442,663 B2
(45) Date of Patent: Oct. 15, 2019

(54) CAGE LIGHTING DEVICE FOR ELEVATOR AND INSTALLATION METHOD THEREFOR

(71) Applicant: MITSUBISHI ELECTRIC CORPORATION, Chiyoda-ku (JP)

(72) Inventors: Hisashi Okabe, Chiyoda-ku (JP); Taiji Sawaki, Chiyoda-ku (JP); Masayuki Minami, Aichi (JP); Toshihisa Ogura, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 257 days.

(21) Appl. No.: 15/557,341

(22) PCT Filed: Apr. 17, 2015

(86) PCT No.: PCT/JP2015/061844
§ 371 (c)(1),
(2) Date: Sep. 11, 2017

(87) PCT Pub. No.: WO2016/166883
PCT Pub. Date: Oct. 20, 2016

(65) Prior Publication Data

US 2018/0050886 A1 Feb. 22, 2018

(51) Int. Cl.
*B66B 11/02* (2006.01)
*B66B 19/00* (2006.01)
(Continued)

(52) U.S. Cl.
CPC ..... *B66B 11/0233* (2013.01); *B66B 19/00* (2013.01); *B66B 19/007* (2013.01); *F21S 8/00* (2013.01); *F21S 8/03* (2013.01); *F21S 8/033* (2013.01); *F21S 8/036* (2013.01); *F21V 15/01* (2013.01); *F21V 15/02* (2013.01)

(58) Field of Classification Search
CPC ..... F21V 15/01; F21V 15/02; B66B 19/00; B66B 19/007; B66B 11/0233; F21S 8/00; F21S 8/03; F21S 8/033; F21S 8/036
See application file for complete search history.

(56) References Cited

U.S. PATENT DOCUMENTS 6,129,441 A * 10/2000 Wu ..... F21S 8/00 362/127
6,736,522 B1 * 5/2004 Cini ..... F21S 2/00 362/145
(Continued)

FOREIGN PATENT DOCUMENTS

WO WO-2007057967 A1 * 5/2007 ..... B66B 11/0233

*Primary Examiner* — Bryon T Gyllstrom
*Assistant Examiner* — Colin J Cattanach
(74) *Attorney, Agent, or Firm* — Xsensus LLP

(57) ABSTRACT

In a cage lighting device for an elevator, a lighting cover includes a main cover, a first auxiliary cover opposing a first cage wall, and a second auxiliary cover opposing a second cage wall. Respective dimensions of the first and second auxiliary covers in a lengthwise direction of the lighting cover are smaller than a dimension of the main cover in the lengthwise direction of the lighting cover. By loosening a first auxiliary cover fastening tool, the first auxiliary cover becomes capable of sliding in the lengthwise direction relative to a lighting cover attachment member between a position adjacent to the main cover and a position contacting the first cage wall.

5 Claims, 4 Drawing Sheets

(51) Int. Cl.

| | |
|---|---|
| ***F21S 8/00*** | (2006.01) |
| ***F21V 15/01*** | (2006.01) |
| ***F21V 15/02*** | (2006.01) |

(56) References Cited

U.S. PATENT DOCUMENTS

| | | | | |
|---|---|---|---|---|
| 9,845,818 | B2 * | 12/2017 | Liu | F21V 17/10 |
| 2014/0063803 | A1 * | 3/2014 | Yaphe | F21V 15/012<br>362/247 |

* cited by examiner

CAGE LIGHTING DEVICE FOR ELEVATOR AND INSTALLATION METHOD THEREFOR

TECHNICAL FIELD

This invention relates to a cage lighting device provided in an upper portion of an elevator cage, and a method of installing the cage lighting device in the cage.

BACKGROUND ART

In a conventional elevator, a pair of lighting devices are disposed in an upper portion of a cage on respective width direction sides. Each lighting device includes a frame body fixed to a ceiling, a plurality of light sources provided in the frame body, and a lighting plate (a design surface cover) provided on a lower portion of the frame body so as to cover the light sources. The lighting plate is disposed over substantially the entire length of the cage in a depth direction (a front-rear direction) thereof (see PTL 1, for example).

CITATION LIST

Patent Literature

[PTL 1] Japanese Patent Application Publication S60-178179 (FIG. 3)

SUMMARY OF THE INVENTION

Problem to be Solved by the Invention

In the conventional elevator described above, an elongated lighting cover that extends over substantially the entire length of the cage in the depth direction thereof is used, and therefore, when the lighting cover is attached to the upper portion of the cage, the lighting cover may contact a cage wall such that either the cage wall or the lighting cover is damaged.

Further, the lighting device is disposed to extend in the depth direction of the cage, and therefore, during installation, the lighting cover can be attached to the frame body by transporting the lighting cover into the cage through a car doorway and then raising the lighting cover without altering the orientation thereof. However, when an attempt is made to dispose the lighting device in a width direction (an opening direction) of the cage so as to extend over substantially the entire length of the cage in the width direction thereof, the lighting cover must be rotated within the cage. Sufficient space for rotating the lighting cover must therefore be secured in the cage, and accordingly, the installability of the lighting device is poor. Moreover, when the lighting cover is rotated, the lighting cover may contact a cage wall such that either the cage wall or the lighting cover is damaged.

This invention has been designed to solve the problems described above, and an object thereof is to obtain a cage lighting device for an elevator and an installation method therefor, with which an elongated lighting cover can be disposed easily in a cage while preventing damage to a cage wall or the lighting cover, thereby achieving an improvement in installability.

Means for Solving the Problem

A cage lighting device for an elevator according to this invention includes: a lighting cover attached to a lighting cover attachment member, which is fixed to an upper portion of the interior of a cage, such that intervals are formed respectively between the lighting cover and mutually opposing first and second cage walls of the cage; and a lighting equipment disposed inside the lighting cover, wherein the lighting cover includes: a main cover fixed to the lighting cover attachment member; a first auxiliary cover that is fixed to the lighting cover attachment member by a first auxiliary cover fastening tool so as to oppose the first cage wall; and a second auxiliary cover that is fixed to the lighting cover attachment member by a second auxiliary cover fastening tool so as to oppose the second cage wall, a dimension of the first auxiliary cover in a lengthwise direction, the lengthwise direction being orthogonal to the first and second cage walls, and a dimension of the second auxiliary cover in the lengthwise direction are respectively smaller than a dimension of the main cover in the lengthwise direction, and by loosening the first auxiliary cover fastening tool, the first auxiliary cover becomes capable of sliding in the lengthwise direction relative to the lighting cover attachment member between a position adjacent to the main cover and a position contacting the first cage wall.

Further, a cage lighting device for an elevator according to this invention includes: a lighting cover attached to a lighting cover attachment member, which is fixed to an upper portion of the interior of a cage, such that intervals are formed respectively between the lighting cover and mutually opposing first and second cage walls of the cage; and a lighting equipment disposed inside the lighting cover, wherein the lighting cover includes: a main cover fixed to the lighting cover attachment member; and an auxiliary cover that is fixed to the lighting cover attachment member by an auxiliary cover fastening tool so as to oppose the first cage wall, a dimension of the auxiliary cover in a lengthwise direction that is orthogonal to the first and second cage walls is smaller than a dimension of the main cover in the lengthwise direction, and by loosening the auxiliary cover fastening tool, the auxiliary cover becomes capable of sliding in the lengthwise direction relative to the lighting cover attachment member between a position adjacent to the main cover and a position contacting the first cage wall.

Furthermore, in an installation method for a cage lighting device for an elevator according to this invention, the cage lighting device having a lighting cover attached to a lighting cover attachment member, which is fixed to an upper portion of the interior of a cage, such that intervals are formed respectively between the lighting cover and mutually opposing first and second cage walls of the cage, and the lighting cover having a main cover and first and second auxiliary covers formed to have a smaller dimension than the main cover in a lengthwise direction that is orthogonal to the first and second cage walls, the installation method includes the steps of: provisionally fixing the first auxiliary cover to the lighting cover attachment member in a position contacting the first cage wall; provisionally fixing the second auxiliary cover to the lighting cover attachment member in a position contacting the second cage wall; fixing the main cover to the lighting cover attachment member in a position where gaps are formed respectively between the main cover and the first and second auxiliary covers; and sliding the first and second auxiliary covers in the lengthwise direction so as to finally fix the first and second auxiliary covers to the lighting cover attachment member in positions contacting the main cover.

Moreover, in an installation method for a cage lighting device for an elevator according to this invention, the cage lighting device having a lighting cover attached to a lighting cover attachment member, which is fixed to an upper portion of the interior of a cage, such that intervals are formed respectively between the lighting cover and mutually opposing first and second cage walls of the cage, and the lighting cover having a main cover and an auxiliary cover formed to have a smaller dimension than the main cover in a lengthwise direction that is orthogonal to the first and second cage walls, the installation method includes the steps of: provisionally fixing the auxiliary cover to the lighting cover attachment member in a position contacting the first cage wall; fixing the main cover to the lighting cover attachment member in a position where a gap is formed between the main cover and the auxiliary cover; and sliding the auxiliary cover in the lengthwise direction so as to finally fix the auxiliary cover to the lighting cover attachment member in a position contacting the main cover.

Effects of the Invention

With the cage lighting device and the installation method therefor according to this invention, an elongated lighting cover can be disposed easily in a cage while preventing damage to a cage wall or the lighting cover, and as a result, an improvement in installability can be achieved.

DESCRIPTION OF EMBODIMENTS

Embodiments of this invention will be described below with reference to the drawings.

First Embodiment

Figure 1:
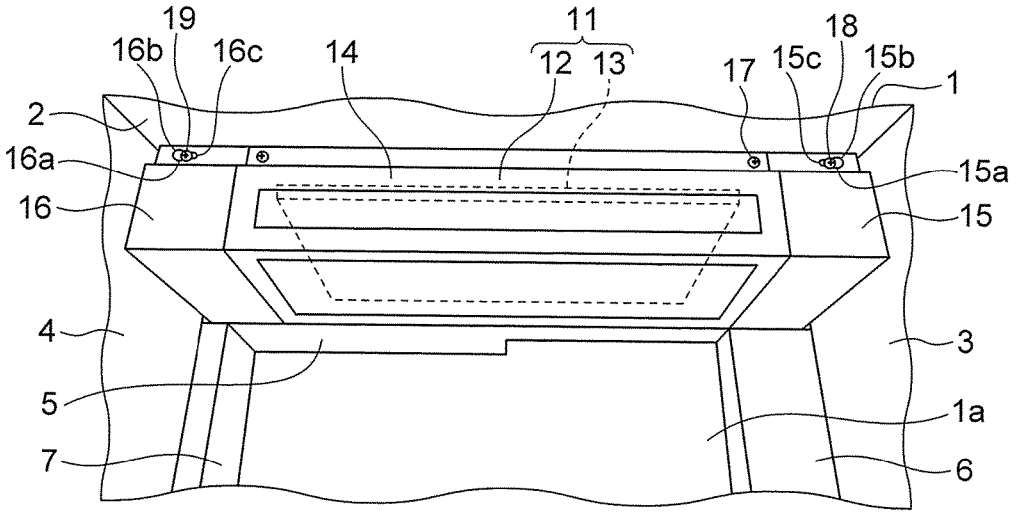
FIG. 1 is a perspective view showing a cage lighting device for an elevator according to a first embodiment of this invention.

FIG. 1 is a perspective view showing a cage lighting device for an elevator according to a first embodiment of this invention. In the drawing, a cage 1 includes a front face, a rear surface opposing the front face, a first side face, a second side face opposing the first side face, and an upper face. A car doorway 1*a* is provided in the front face of the cage 1. FIG. 1 is a view showing an upper portion of the car doorway 1*a* from inside the cage 1. A canopy 2 is provided on the upper face of the cage 1.

A first side wall 3 is disposed on the first side face of the cage 1 as a first cage wall. A second side wall 4 is disposed on the second side face of the cage 1 as a second cage wall. The first and second side walls 3, 4 oppose each other.

A doorway upper plate 5 is provided in an upper portion of the car doorway 1*a* formed in the front face of the cage 1. A wing wall 6 is provided on one side of the car doorway 1*a*. The wing wall 6 is adjacent to the first side wall 3 so as to form a corner portion therewith. A doorstop post 7 is provided on the other side of the car doorway 1*a*. The doorstop post 7 is adjacent to the second side wall 4 so as to form a corner portion therewith.

A lighting cover attachment member 8 (FIG. 2) is fixed (screwed) to the canopy 2. A cage lighting device 11 is attached to the lighting cover attachment member 8 and the doorway upper plate 5. The cage lighting device 11 has a substantially rectangular parallelepiped-shaped outer form (a shape in which an upper portion of a front face (a face opposing the rear face of the cage 1) of the rectangular parallelepiped is recessed toward a landing side).

The cage lighting device 11 includes a lighting cover 12, and a lighting equipment 13 disposed inside the lighting cover 12 as a lighting source. A fluorescent lamp, an incandescent lamp, an LED (Light Emitting Diode), or the like, for example, may be used as the lighting equipment 13.

The lighting cover 12 is disposed such that intervals are formed respectively between the lighting cover 12 and the first and second side walls 3, 4. In other words, gaps are provided respectively between the lighting cover 12 and the first side wall 3 and between the lighting cover 12 and the second side wall 4. Further, the lighting cover 12 is configured such that a dimension thereof in an orthogonal direction to the first and second side walls 3, 4, or in other words a lengthwise direction (a left-right direction in FIG. 1) that is parallel to a width direction of the cage 1, is greater than a width dimension of the car doorway 1*a*.

Further, the lighting cover 12 is divided into a plurality of pieces (three pieces in this example) in the lengthwise direction. As a result, the lighting cover 12 includes a main cover (a central cover) 14 disposed intermediately in the lengthwise direction, a first auxiliary cover 15 opposing the first side wall 3, and a second auxiliary cover 16 opposing the second side wall 4.

The first auxiliary cover 15 is positioned on a first end portion of the lighting cover 12 in the lengthwise direction so as to contact an end portion of the main cover 14 on the first side wall 3 side. The second auxiliary cover 16 is positioned on a second end portion of the lighting cover 12 in the lengthwise direction so as to contact an end portion of the main cover 14 on the second side wall 4 side. Respective faces of the first and second auxiliary covers 15, 16 facing the interior of the cage 1 are flush with a face of the main cover 14 that faces the interior of the cage 1.

A dimension of the first auxiliary cover 15 in the lengthwise direction of the lighting cover 12 and a dimension of the second auxiliary cover 16 in the lengthwise direction of the lighting cover 12 are respectively smaller than a dimension of the main cover 14 in the lengthwise direction of the lighting cover 12. In this example, the dimension of the first auxiliary cover 15 in the lengthwise direction of the lighting cover 12 is identical to the dimension of the second auxiliary cover 16 in the lengthwise direction of the lighting cover 12.

Further, a gap between the first auxiliary cover 15 and the first side wall 3 (a dimension extending in the width direction of the cage 1) and a gap between the second auxiliary cover 16 and the second side wall 4 (a dimension extending in the width direction of the cage 1) are sufficiently smaller than the respective dimensions of the first and second auxiliary covers 15, 16 in the lengthwise direction of the lighting cover 12.

The main cover 14 is fixed to the lighting cover attachment member 8 by a plurality of main cover fastening tools 17. The first auxiliary cover 15 is fixed to the lighting cover attachment member 8 by a first auxiliary cover fastening tool 18. The second auxiliary cover 16 is fixed to the lighting cover attachment member 8 by a second auxiliary cover fastening tool 19. Screws are used respectively as the fastening tools 17, 18, 19.

A first hole 15*a* through which the first auxiliary cover fastening tool 18 passes is provided in the first auxiliary cover 15. The first hole 15*a* includes a large diameter portion 15*b* that allows a head portion of the first auxiliary cover fastening tool 18 to pass through, and an elongated hole portion 15*c* that is connected to the main cover 14 side of the large diameter portion 15*b* and does not allow the head portion of the first auxiliary cover fastening tool 18 to pass through.

By loosening the first auxiliary cover fastening tool 18, the first auxiliary cover 15 becomes capable of sliding relative to the lighting cover attachment member 8 in the lengthwise direction of the lighting cover 12 between a position adjacent to the main cover 14 and a position contacting the first side wall 3.

A second hole 16*a* through which the second auxiliary cover fastening tool 19 passes is provided in the second auxiliary cover 16. The second hole 16*a* includes a large diameter portion 16*b* that allows a head portion of the second auxiliary cover fastening tool 19 to pass through, and an elongated hole portion 16*c* that is connected to the main cover 14 side of the large diameter portion 16*b* and does not allow the head portion of the second auxiliary cover fastening tool 19 to pass through.

By loosening the second auxiliary cover fastening tool 19, the second auxiliary cover 16 becomes capable of sliding relative to the lighting cover attachment member 8 in the lengthwise direction of the lighting cover 12 between a position adjacent to the main cover 14 and a position contacting the second side wall 4.

The main cover 14, the first auxiliary cover 15, and the second auxiliary cover 16 are fixed to the doorway upper plate 5 by a plurality of screws (not shown) from the outside (the landing side) of the cage 1. A plurality of holes through which the screws for fixing the main cover 14 pass and a plurality of elongated holes (not shown) through which the screws for fixing the first and second auxiliary covers 15, 16 pass are provided in the doorway upper plate 5. A plurality of screw hole members (nuts or the like) to which the screws penetrating the doorway upper plate 5 are screwed are fixed to the covers 14, 15, 16.

Figure 2:
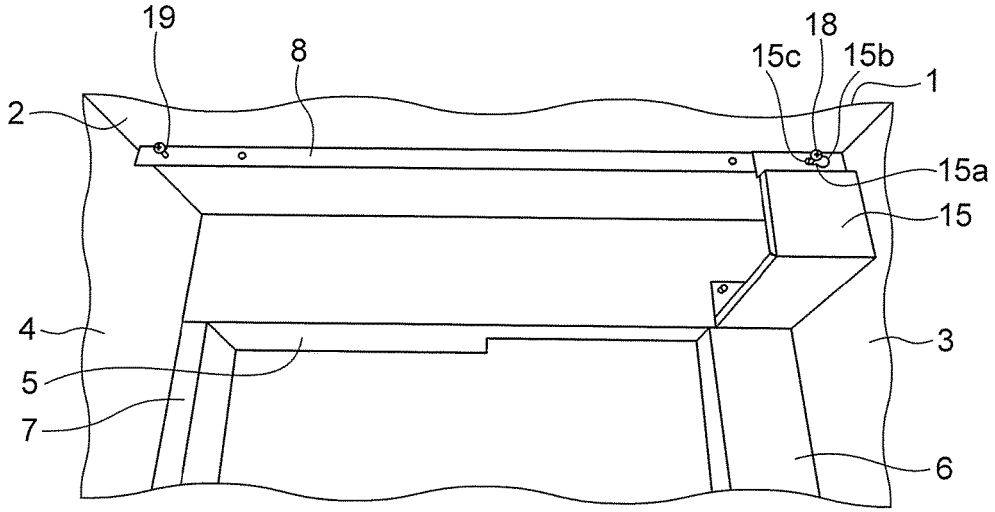
FIG. 2 is a perspective view showing a condition during installation of the cage lighting device of FIG. 1.

Next, a method of installing the cage lighting device 11 will be described. The first and second auxiliary cover fastening tools 18, 19 are attached to the lighting cover attachment member 8 in advance. Next, as shown in FIG. 2, the first auxiliary cover 15 is attached to the lighting cover attachment member 8 and the doorway upper plate 5. At this time, the first auxiliary cover 15 is fixed provisionally in the position contacting the first side wall 3.

Figure 3:
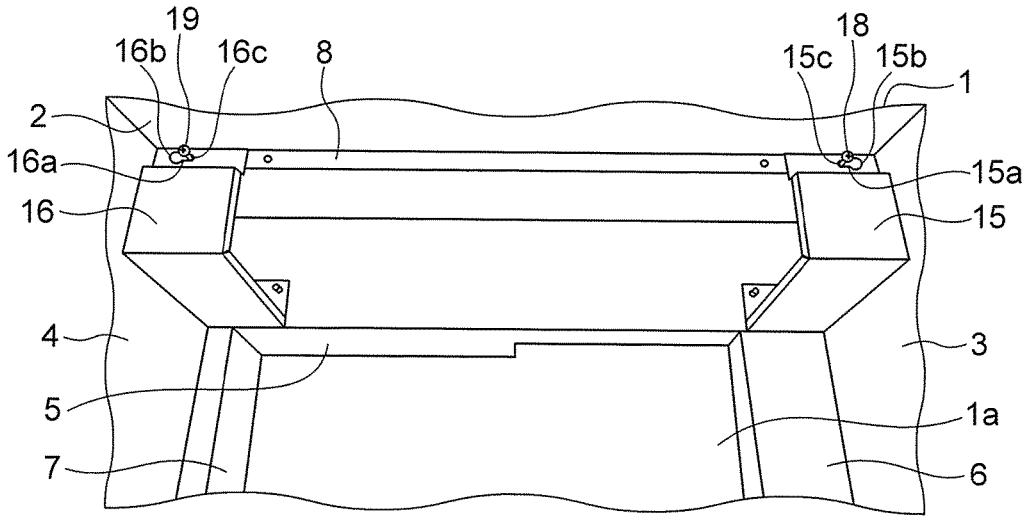
FIG. 3 is a perspective view showing a condition following FIG. 2.

Next, as shown in FIG. 3, the second auxiliary cover 16 is attached to the lighting cover attachment member 8 and the doorway upper plate 5. At this time, the second auxiliary cover 16 is fixed provisionally in the position contacting the second side wall 4.

Figure 4:
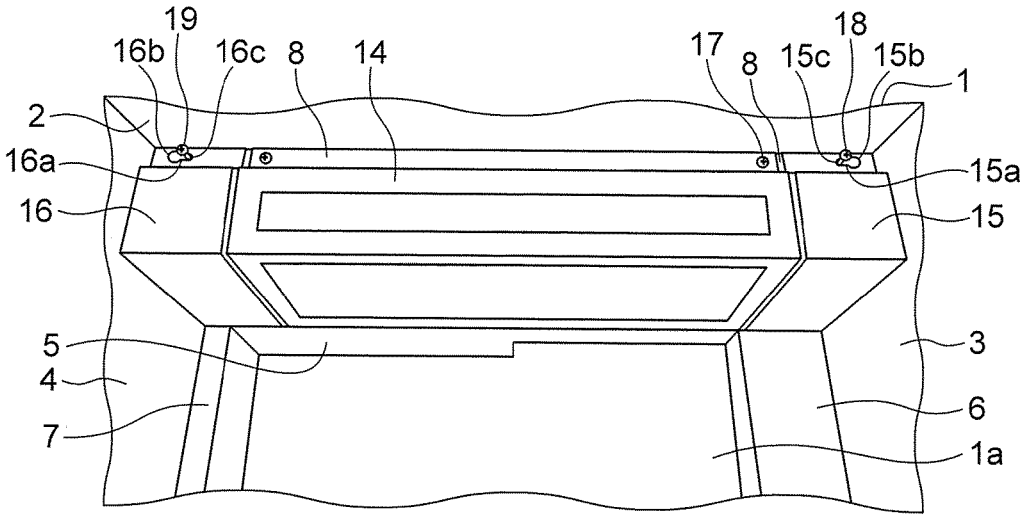
FIG. 4 is a perspective view showing a condition following FIG. 3.

Next, as shown in FIG. 4, the main cover 14 is attached (finally fixed) to the lighting cover attachment member 8 and the doorway upper plate 5. At this time, a gap is formed between the main cover 14 and the first auxiliary cover 15. Further, a gap is formed between the main cover 14 and the second auxiliary cover 16.

Finally, as shown in FIG. 1, the first and second auxiliary covers 15, 16 are respectively caused to slide in the lengthwise direction of the lighting cover 12 so as to be brought into contact with and finally fixed to the main cover 14. Although not shown in FIGS. 2 to 4, the lighting equipment 13 is attached to the doorway upper plate 5 before the main cover 14 is attached to the lighting cover attachment member 8.

With the cage lighting device 11 and the installation method therefor described above, the auxiliary covers 15, 16, which are smaller than the main cover 14, are attached to the lighting cover attachment member 8 first. Furthermore, the auxiliary covers 15, 16 are initially brought into contact with the first and second side walls 3, 4, respectively, whereupon the elongated main cover 14 is attached to the lighting cover attachment member 8.

Hence, the elongated lighting cover 12 (which has a substantially identical dimension to the width direction dimension of the cage 1) can be disposed in the cage 1 easily without damaging the side walls 3, 4 or the lighting cover 12, and therefore an improvement in installability can be achieved. Moreover, the cage lighting device 11 can be retrofitted from inside the cage 1 by a single operator. Furthermore, the lighting cover 12 can be disposed in the cage 1 easily even when the lengthwise direction of the lighting cover 12 extends in the width direction of the cage 1.

Second Embodiment

Figure 5:
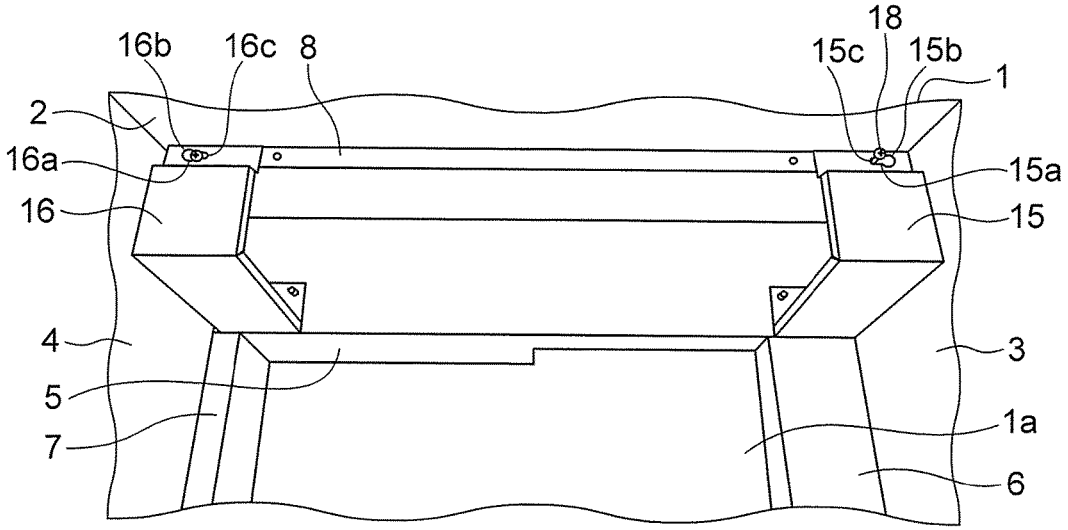
FIG. 5 is a perspective view showing a procedure for installing a cage lighting device according to a second embodiment of this invention.

Next, a second embodiment of this invention will be described. The cage lighting device 11 according to the second embodiment is configured identically to the first embodiment. In the second embodiment, only the procedures for installing the lighting cover 12 differ from the first embodiment. More specifically, in the second embodiment, the first auxiliary cover 15 is fixed provisionally in a similar manner to the first embodiment, whereupon the second auxiliary cover 16 is fixed finally in the correct position, as shown in FIG. 5, rather than the position contacting the second side wall 4.

Figure 6:
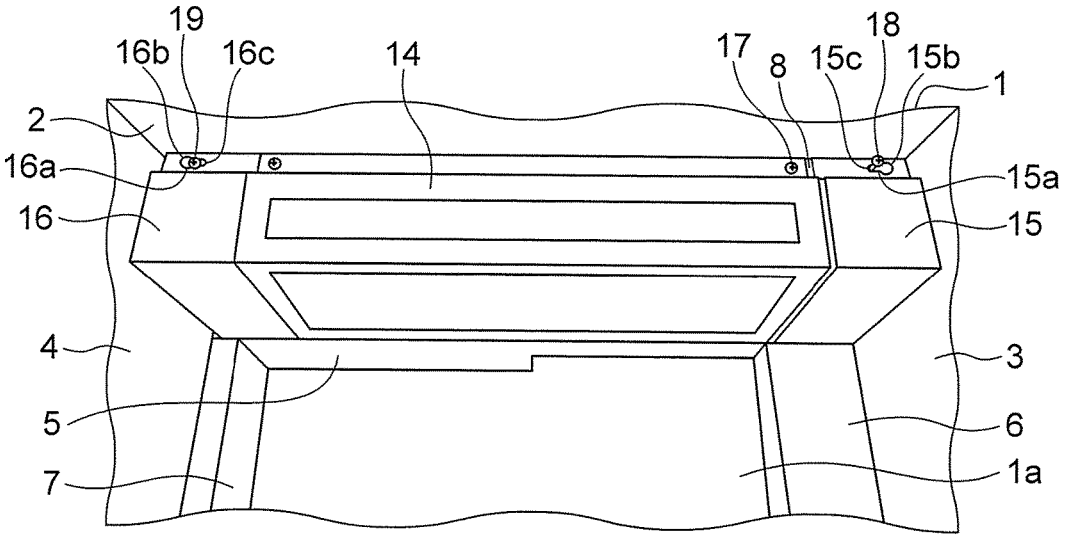
FIG. 6 is a perspective view showing a condition following FIG. 5.

Next, similarly to the first embodiment, the main cover 14 is fixed to the lighting cover attachment member 8 and the doorway upper plate 5. At this time, as shown in FIG. 6, a gap is formed between the main cover 14 and the first auxiliary cover 15, but the second auxiliary cover 16 contacts the main cover 14. Subsequent installation procedures are similar or identical to the first embodiment.

Likewise with these installation procedures, the elongated lighting cover 12 can be disposed in the cage 1 easily without damaging the side walls 3, 4 or the lighting cover 12, and therefore an improvement in installability can be achieved. Moreover, the cage lighting device 11 can be retrofitted from inside the cage 1 by a single operator. Further, the lighting cover 12 can be disposed in the cage 1 easily even when the lengthwise direction of the lighting cover 12 extends in the width direction of the cage 1.

Third Embodiment

Figure 7:
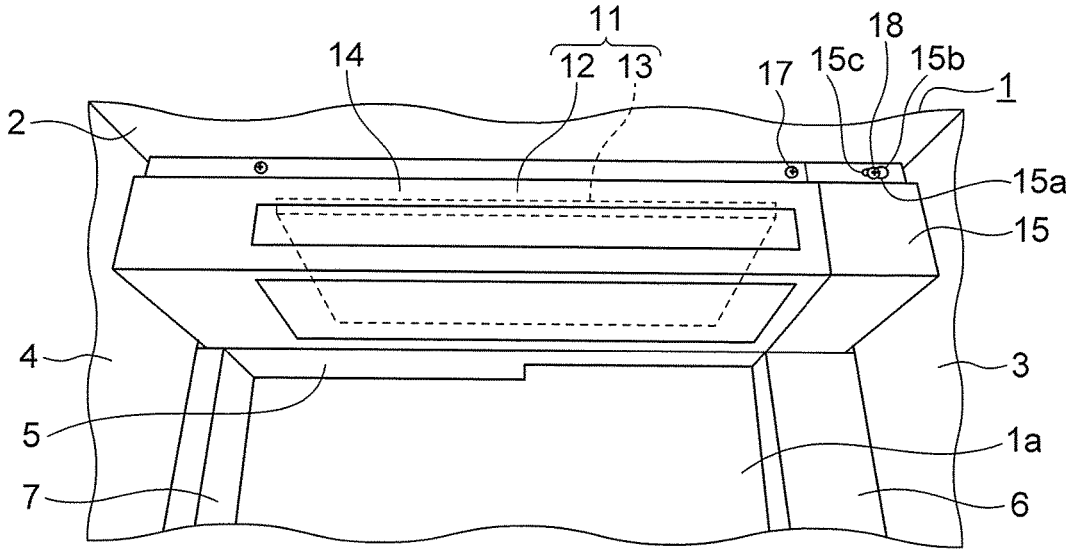
FIG. 7 is a perspective view showing a cage lighting device for an elevator according to a third embodiment of this invention.

FIG. 7 is a perspective view showing the cage lighting device 11 according to a third embodiment of this invention. The main cover 14 according to the third embodiment is formed by integrating the main cover 14 of the first embodiment with the second auxiliary cover 16. Only the first auxiliary cover 15 of the first embodiment is used as an auxiliary cover. In other words, the lighting cover 12 is divided into two pieces in the lengthwise direction. All other configurations are similar or identical to the first embodiment.

Figure 8:
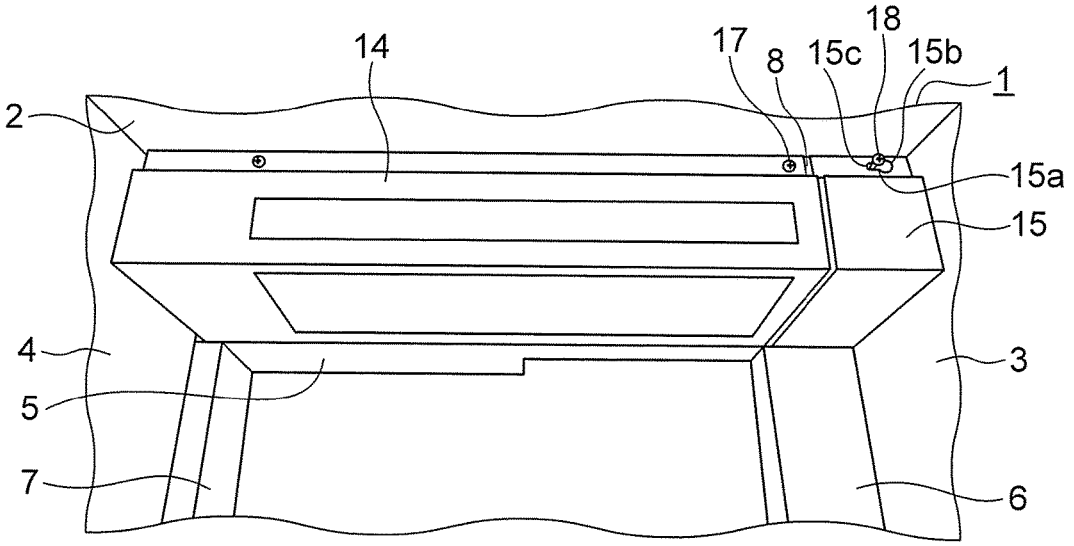
FIG. 8 is a perspective view showing a condition during installation of the cage lighting device of FIG. 7.

Next, procedures for installing the lighting cover 12 will be described. First, the auxiliary cover 15 is fixed provisionally in a similar manner to the first embodiment. Next, as shown in FIG. 8, the main cover 14 is fixed in the correct position. At this time, a gap is formed between the main cover 14 and the second side wall 4. Further, a gap is formed between the main cover 14 and the auxiliary cover 15. All other procedures are similar or identical to the second embodiment.

Likewise with the cage lighting device 11 and the installation method therefor described above, the elongated lighting cover 12 can be disposed in the cage 1 easily without damaging the side walls 3, 4 or the lighting cover 12, and therefore an improvement in installability can be achieved. Moreover, the cage lighting device 11 can be retrofitted from inside the cage 1 by a single operator. Further, the lighting cover 12 can be disposed in the cage 1 easily even when the lengthwise direction of the lighting cover 12 extends in the width direction of the cage 1.

Note that in the examples described above, the side wall on the right-hand side, when viewing the car doorway 1*a* from inside the cage 1, is set as the first side wall 3, and the side wall on the left-hand side is set as the second side wall 4. However, the side walls may be reversed.

Further, in the examples described above, the first and second side walls 3, 4 are set respectively as the first and second cage walls, but instead, a front face wall and a rear face wall of the cage 1 may be set respectively as the first and second cage walls. In other words, a lighting cover having the depth direction of the cage as the lengthwise direction may be used instead.

Furthermore, in the examples described above, the auxiliary cover is made capable of sliding by forming the hole through which the auxiliary cover fastening tool passes from an elongated hole, but instead, the auxiliary cover may be made capable of sliding by providing a hook portion that is hooked to the lighting cover attachment member on an upper portion of the auxiliary cover.

Moreover, the main cover may be divided into a plurality of pieces in the lengthwise direction of the lighting cover.

Further, in the first and second embodiments, the respective lengthwise direction dimensions of the first and second auxiliary covers 15, 16 are set to be identical, but first and second auxiliary covers having different sizes may be used.

Furthermore, two or more cage lighting devices may be disposed in a single cage.

Moreover, there are no particular limitations on the overall layout of the elevator.

Further, this invention may be applied to a cage lighting device for various types of elevators, such as a machine room-less elevator, a double-deck elevator, or a one-shaft multi-cage type elevator, for example.

The invention claimed is:

1. A cage lighting device for an elevator, comprising:

a lighting cover attached to a lighting cover attachment member, which is fixed to an upper portion of the interior of a cage, such that intervals are formed respectively between the lighting cover and mutually opposing first and second cage walls of the cage; and a lighting equipment disposed inside the lighting cover, wherein the lighting cover includes:

a main cover fixed to the lighting cover attachment member;

a first auxiliary cover that is fixed to the lighting cover attachment member by a first auxiliary cover fastening tool so as to oppose the first cage wall; and a second auxiliary cover that is fixed to the lighting cover attachment member by a second auxiliary cover fastening tool so as to oppose the second cage wall, a dimension of the first auxiliary cover in a lengthwise direction, the lengthwise direction being orthogonal to the first and second cage walls, and a dimension of the second auxiliary cover in the lengthwise direction are respectively smaller than a dimension of the main cover in the lengthwise direction, and by loosening the first auxiliary cover fastening tool, the first auxiliary cover becomes capable of sliding in the lengthwise direction relative to the lighting cover attachment member between a position adjacent to the main cover and a position contacting the first cage wall.

2. The cage lighting device for an elevator according to claim 1, wherein, by loosening the second auxiliary cover fastening tool, the second auxiliary cover becomes capable of sliding in the lengthwise direction relative to the lighting cover attachment member between a position adjacent to the main cover and a position contacting the second cage wall.

3. A cage lighting device for an elevator, comprising:

a lighting cover attached to a lighting cover attachment member, which is fixed to an upper portion of the interior of a cage, such that intervals are formed respectively between the lighting cover and mutually opposing first and second cage walls of the cage; and a lighting equipment disposed inside the lighting cover, wherein the lighting cover includes:

a main cover fixed to the lighting cover attachment member; and an auxiliary cover that is fixed to the lighting cover attachment member by an auxiliary cover fastening tool so as to oppose the first cage wall, a dimension of the auxiliary cover in a lengthwise direction that is orthogonal to the first and second cage walls is smaller than a dimension of the main cover in the lengthwise direction, and by loosening the auxiliary cover fastening tool, the auxiliary cover becomes capable of sliding in the lengthwise direction relative to the lighting cover attachment member between a position adjacent to the main cover and a position contacting the first cage wall.

4. An installation method for a cage lighting device for an elevator, the cage lighting device having a lighting cover attached to a lighting cover attachment member, which is fixed to an upper portion of the interior of a cage, such that intervals are formed respectively between the lighting cover and mutually opposing first and second cage walls of the cage, and the lighting cover having a main cover and first and second auxiliary covers formed to have a smaller dimension than the main cover in a lengthwise direction that is orthogonal to the first and second cage walls, the installation method comprising the steps of:

provisionally fixing the first auxiliary cover to the lighting cover attachment member in a position contacting the first cage wall;

provisionally fixing the second auxiliary cover to the lighting cover attachment member in a position contacting the second cage wall;

fixing the main cover to the lighting cover attachment member in a position where gaps are formed respectively between the main cover and the first and second auxiliary covers; and sliding the first and second auxiliary covers in the lengthwise direction so as to finally fix the first and second auxiliary covers to the lighting cover attachment member in positions contacting the main cover.

5. An installation method for a cage lighting device for an elevator, the cage lighting device having a lighting cover attached to a lighting cover attachment member, which is fixed to an upper portion of the interior of a cage, such that intervals are formed respectively between the lighting cover and mutually opposing first and second cage walls of the cage, and the lighting cover having a main cover and an auxiliary cover formed to have a smaller dimension than the main cover in a lengthwise direction that is orthogonal to the first and second cage walls, the installation method comprising the steps of:

provisionally fixing the auxiliary cover to the lighting cover attachment member in a position contacting the first cage wall;

fixing the main cover to the lighting cover attachment member in a position where a gap is formed between the main cover and the auxiliary cover; and sliding the auxiliary cover in the lengthwise direction so as to finally fix the auxiliary cover to the lighting cover attachment member in a position contacting the main cover.

* * * * *